US007108029B2

(12) United States Patent
Albright

(10) Patent No.: US 7,108,029 B2
(45) Date of Patent: Sep. 19, 2006

(54) WOOD SPLITTER WITH MULTIPLE WOOD SPLITTING WEDGES ON A ROTATING MEMBER

(76) Inventor: David B. Albright, 7450 VT Route 15, Jeffersonville, VT (US) 05464

( * ) Notice: Subject to any disclaimer, the term of this patent is extended or adjusted under 35 U.S.C. 154(b) by 104 days.

(21) Appl. No.: 10/867,705

(22) Filed: Jun. 16, 2004

(65) Prior Publication Data

US 2005/0279423 A1 Dec. 22, 2005

(51) Int. Cl.
*B27L 7/02* (2006.01)
*B27L 7/06* (2006.01)

(52) U.S. Cl. ..... 144/193.2; 144/195.8

(58) Field of Classification Search ..... 144/193.1, 144/193.2, 195.5–195.8
See application file for complete search history.

(56) References Cited

U.S. PATENT DOCUMENTS 3,077,214 A 2/1963 Brukner
3,862,651 A * 1/1975 Heikkinen ..... 144/4.6
4,353,401 A * 10/1982 Schilling ..... 144/195.1
4,371,019 A 2/1983 Jeffrey
4,431,362 A 2/1984 Wech, Jr. et al.
4,458,737 A * 7/1984 Klug ..... 144/195.1
5,337,810 A * 8/1994 McCormack ..... 144/195.1
5,957,175 A 9/1999 Smith

* cited by examiner

*Primary Examiner*—Lowell A. Larson
*Assistant Examiner*—Shelley Self
(74) *Attorney, Agent, or Firm*—Jacobson Holman PLLC

(57) ABSTRACT

A woodsplitting machine has a plurality of wedges of various sizes and configurations radially attached to a rotational member mounted on the frame behind the log cradle such that an operator can quickly and easily rotate the appropriate wedge into position depending on the diameter of the log in the cradle to be split. The rotational member can be hydraulically actuated such that the wedges can be rotated around the longitudinal axis of the machine with little effort for the operator. An alternate embodiment provides that the rotational member be manually rotated such that the wedges can be rotated around the longitudinal axis of the machine by the hand of the operator.

20 Claims, 7 Drawing Sheets

WOOD SPLITTER WITH MULTIPLE WOOD SPLITTING WEDGES ON A ROTATING MEMBER

BACKGROUND OF INVENTION

1. Field of Invention

The present invention relates to a machine or apparatus for splitting wooden logs into small pieces useful as firewood. More specifically, the present invention relates to a vehicle mounted wood splitter operated by hydraulic pressure to force the cut wood logs through a splitting wedge which splits the cut log into a desired number of pieces.

2. Description of Related Art

The vast majority of woodsplitters to which the present invention is directed generally employ a ram-type mechanism which forces a "blocked" piece of wood of some maximal length into a stationary splitting wedge having sharpened edges. As the blocked piece or cut log is axially advanced into the wedge, the log is split into a plurality of sector-shaped pieces along cleavage lines that are generally directed radially with respect to the center axis and along medullar rays of the cut log. Typical examples of such devices are disclosed in U.S. Pat. Nos. 3,077,214, 3,862,651, 4,371,019, 4,431,362, 5,337,810 and 5,957,175.

The diameter of the logs fed to the splitting wedge may vary greatly. The industry ideal is to split logs so that the resulting split pieces are of a uniform size. Pieces too large in size result in customers having to manually split their wood further, whereas pieces that are too small in size cannot be used efficiently. In order to maintain this uniform size, larger diameter logs must be cut into a greater number of pieces than smaller diameter logs. In the course of cutting a sequence of logs, it often happens that logs of widely different diameters are encountered, thereby requiring frequent adjustment of the apparatus so that the appropriate number of pieces are generated from each log. Such adjustment of the apparatus to accommodate varying sized logs requires considerable operator time and down time of the machine, thereby increasing the cost of the log splitting operation.

The prior art includes wood splitting machines that have interchangeable wedges to accommodate different sized logs that necessitate manual removal and change of one size wedge to another. Such changeover of the different wedges, however, causes the operator to cease production temporarily with resultant lost operator time and machine down time. Other wood splitting machines include wedges on a pillar type mechanism that allows the operator to raise more wedges when the diameter of the log is larger. This type of equipment, however, frequently results in increased small waste pieces.

What is needed in the art is a wood splitter which can be quickly adjusted to the desired wedge size so that logs of varying size can be split into a uniform size with a minimum of adjustment time both for the operator and the machine.

SUMMARY OF THE INVENTION

In order to overcome the deficiencies in the prior art and provide a wood splitter which can accommodate logs of varying size for splitting into a uniform size with a minimum of machine downtime, the present invention has a plurality of wedges of various sizes mounted radially on a rotational member. Two or more and, preferably at least three, splitting wedges of different sizes are mounted around the rotational member which is positioned below and rearwardly of the action end of the log cradle or bed of the machine.

In one embodiment the wedges are rigidly mounted on the rotational member by welding a wedge blade outer edge to the rotational member so that the splitting wedges extend outwardly from the rotational member in a generally radial direction. A securing rod mounted on the frame of the machine engages the securing blade of a non-working wedge to hold the rotational member and the wedges mounted thereon in a fixed position during the splitting operation.

The rotational member can be rotated in a generally circular path about a longitudinal axis of the machine so that each of the splitting wedges carried on the rotational member can be selectively positioned for splitting logs placed in the log cradle or bed. An operator can then quickly and easily switch from one size splitting wedge to another size splitting wedge by simply rotating the rotational member in order to place the appropriate wedge into the action position behind the log cradle or bed. At the same time, the bed or cradle guiding the log to be split can be adjusted vertically to properly center the log at the center of the selected wedge.

The rotational member with its splitting wedges radially attached thereon is preferably removable from the rear end of the wood splitter frame so that different sets of splitting wedges could be used on the same wood splitting machine. For example, using two rotational members supporting three splitting wedge sizes, one set of wedges could be mounted on one rotational member for splitting various sizes of smaller logs, and a different set of wedges could be mounted on the other rotational member for splitting different size larger logs. This removable feature provides greater flexibility for the wood splitting machine of the present invention to operate over a large range of log sizes.

The rotational member and the log cradle are both preferably operated hydraulically utilizing the hydraulic system of the wood splitter, or of the vehicle transporting the wood splitting machine. Such hydraulic operation requires little effort for the operator and can be accomplished quickly and easily. In an alternative embodiment, the rotational member can be manually rotated by hand by the operator, if desired. However, the height adjustment of the log cradle should be hydraulically actuated as is typical on prior art wood splitters.

It will be understood by those skilled in the art that any conventional hydraulic side mounted lifting device could be used in conjunction with the present invention. Such devices lift one or more logs to a feeding position above and adjacent to the log cradle or bed so that individual logs can easily be placed into the log cradle for splitting. Such lifting devices are known in the art and are disclosed in the prior art patents previously identified in the Background of the Invention section earlier in this specification.

In another embodiment of the present invention, the splitting wedges are each removably attached to the rotational member by use of fasteners or the like. The use of removable wedges allows the machine to be equipped with a multitude of splitting wedges over a large range of sizes, without having to remove the rotational member, simply by replacing the wedges.

Another feature of the present invention contemplates that the size of the log in the machine cradle or bed be sensed by the machine. If the sensed log width or diameter changes such that the splitting wedge in position behind the machine cradle or bed is not appropriate, the machine pauses to automatically allow the rotational member to move an appropriate wedge into position. This automatic selection of the proper size splitting wedge based upon the sensed width or diameter of the log in the log cradle or bed assures that the log will be split into proper sized pieces, irrespective of whether the operator may or may not have noticed a change in the log size.

It is therefore an object of the present invention to provide a wood splitting machine which has a plurality of splitting wedges of various sizes mounted on a rotational member such that an operator can quickly and easily rotate the appropriate splitting wedge into position depending on the diameter of the log to be split.

Another object of the present invention is to provide a wood splitting machine in accordance with the preceding object in which the rotational member is preferably actuated hydraulically so that the splitting wedges can be rotated around the central or longitudinal axis of the rotational member with little effort by the operator or, alternatively, to allow the rotational member to be manually actuated such that the wedges can be rotated around the longitudinal axis of the rotational member by the hand of the operator.

A further object of the present invention is to provide a wood splitting machine in accordance with the preceding objects in which at least two, and preferably three, different splitting wedges are equally spaced around the rotational member such that the wedges extend outwardly from the rotational member in a generally radial direction and an operator can quickly and easily rotate the appropriate wedge into position depending on the diameter of the log to be split.

Still another object of the present invention is to provide a wood splitting machine in accordance with the preceding objects in which the rotational member and splitting wedges mounted thereon can be replaced with a different rotational member having a different size set of splitting wedges mounted thereon.

Yet another object of the present invention is to provide a wood splitting machine which automatically selects a desired wedge size and rotates the rotational member as necessary to place the selected wedge into position based upon the width or diameter of the log in the machine cradle or bed.

A still further object of the present invention is to provide a wood splitting machine having a rotational member supporting multiple splitting wedges in which the different wedges are removably attached to the rotational member by use of fasteners or the like.

Yet another object of this invention to be specifically enumerated herein is to provide a wood splitter in accordance with the preceding objects and which will conform to conventional forms of manufacture, be of simple construction and easy to use so as to provide a machine that will be economically feasible, long lasting and relatively trouble free in operation.

These together with other objects and advantages that will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

The drawings serve to illustrate the present invention but are not intended to be drawn to scale.

DETAILED DESCRIPTION AND PREFERRED EMBODIMENTS

Figure 1:
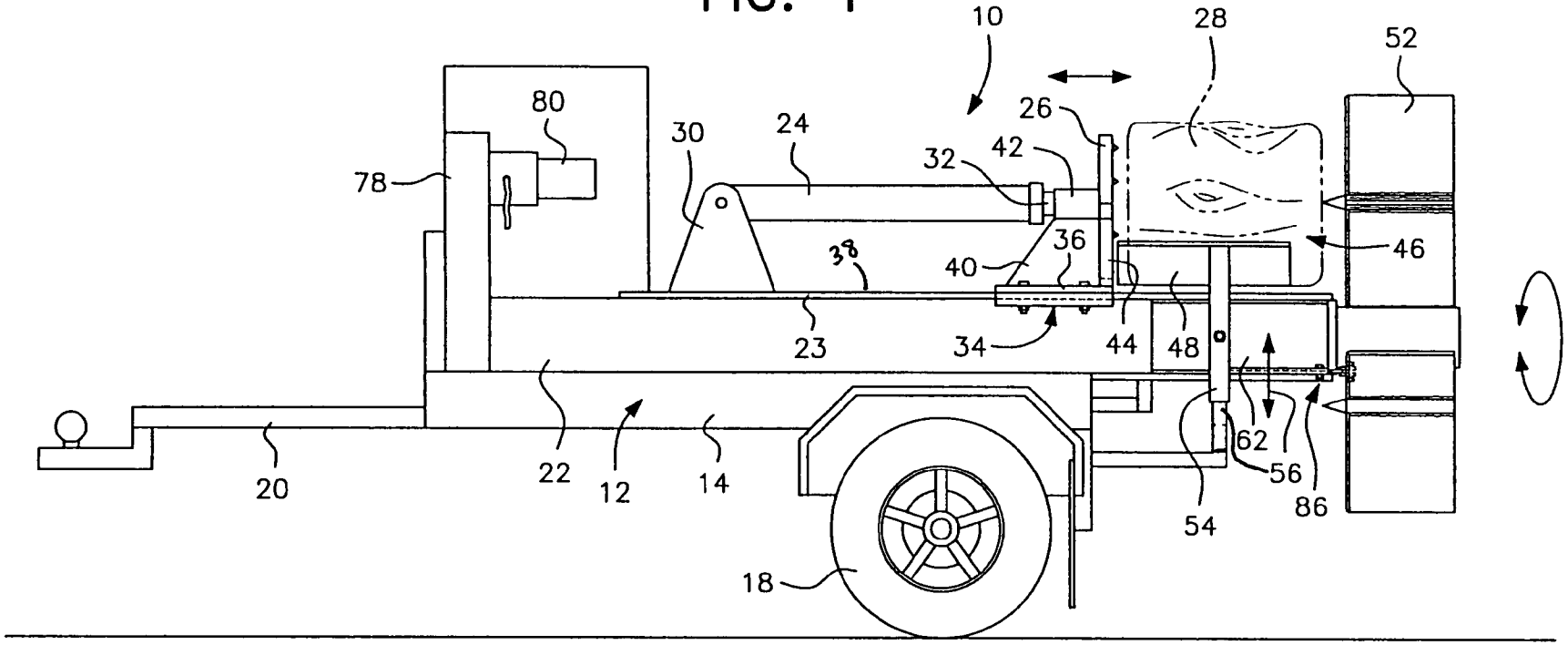
FIG. 1 shows a schematic side elevational view of a wood splitting machine having multiple splitting wedges mounted on a rotational member in accordance with the present invention.

Although preferred embodiments of the invention are explained in detail, it is to be understood that other embodiments are possible. Accordingly, it is not intended that the invention is to be limited in its scope to the details of constructions and arrangement of components set forth in the following description or illustrated in the drawings. The invention is capable of other embodiments and of being practiced or carried out in various ways. Also, in describing the preferred embodiments, specific terminology will be resorted to for the sake of clarity. It is to be understood that each specific term includes all technical equivalents which operate in a similar manner to accomplish a similar purpose.

Referring to FIG. 1, a wood splitter with multiple wood splitting wedges on a rotating member in connection with the present invention is generally designated by reference numeral 10. The wood splitting machine 10 includes a chassis or frame generally designated by reference numeral 12, having spaced, longitudinally extending side members 14, joined by spaced cross members 16 to form a typical trailer structure. The chassis or frame 12 is mounted on a pair of wheels 18 in a conventional manner and is provided with a conventional trailer tongue 20 whereby the log splitting apparatus may be attached, for example, to a pickup truck, tractor or other prime mover and transported to a desired location. Alternatively, the machine could be mounted on four wheels and self-propelled.

A conventional internal combustion engine, such as a gasoline or diesel engine (not shown), is mounted on the chassis 12. The engine is adapted to power a conventional hydraulic pump and circuit which supplies hydraulic fluid under pressure through a hydraulic accumulator to various hydraulically actuated power devices incorporated in the wood splitter of the present invention.

Positioned on top of the chassis or frame 12 is a central beam 22 preferably made of steel or other suitable metal of sufficient width and strength to support components described herein and a log of up to about 16–20 in. in diameter. The beam 22 extends longitudinally the length of the chassis 12 and extends outwardly beyond the chassis rear. The central beam 22 can be for example an H-beam or a tubular steel frame. In a preferred embodiment, the beam 22 is a rectangular tubular beam of heavy gauge steel.

Welded or otherwised fixed on the top side of the central beam 22 is a horizontal plate 23 which supports the main power ram or hydraulic cylinder 24 with a ram head 26 for pushing a log 28 for splitting. The power ram 24 is mounted for generally horizontal action with the rear end supported by a pair of generally vertically spaced anchor plates 30 welded onto the top surface 38 of the horizontal plate 23. The front end of the piston rod 32 adjacent the ram head 26 is supported on a sliding carriage, generally designated by reference numeral 34. The carriage 34 includes a horizontal sliding plate 36 which rests on the top surface 38 of the plate 23, a vertical support plate 40, and collar 42 surrounding the leading end of the piston rod 32 behind the ram head 26. Another vertical plate 44, generally perpendicular to plate 40, provides a wider face to the log end being pushed by ram head 26 and serves to reinforce the leading edge of carriage 34.

Figure 2:
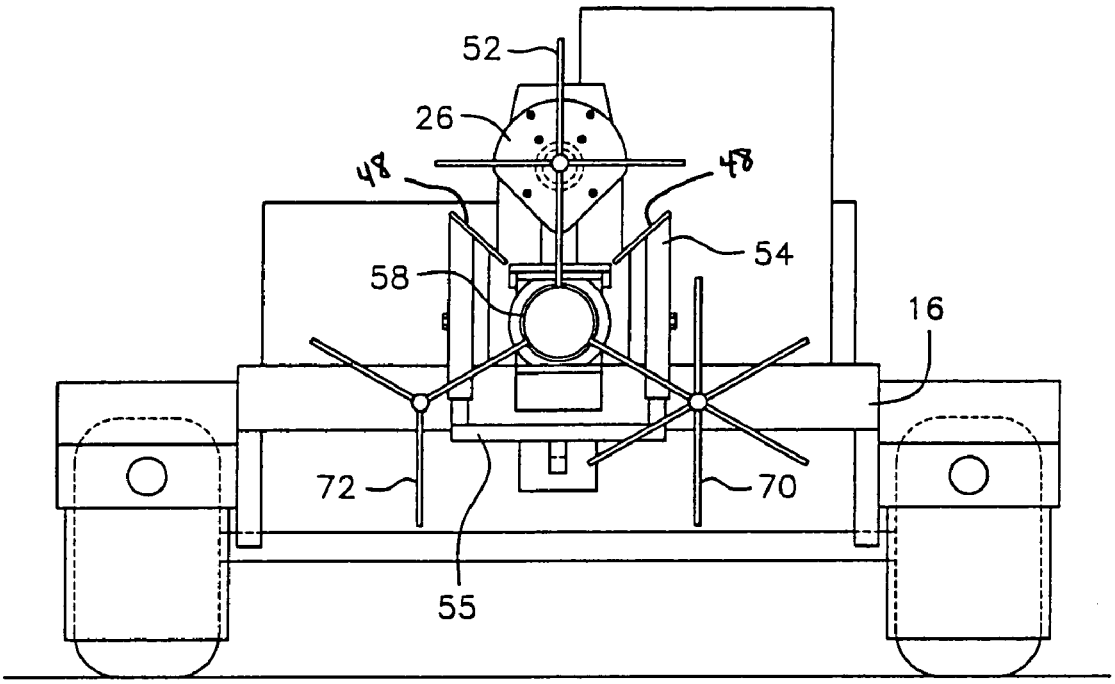
FIG. 2 shows a rear view of the wood splitting machine of FIG. 1 showing three splitting wedges mounted on a rotation member at the rear of the machine.
Figure 3:
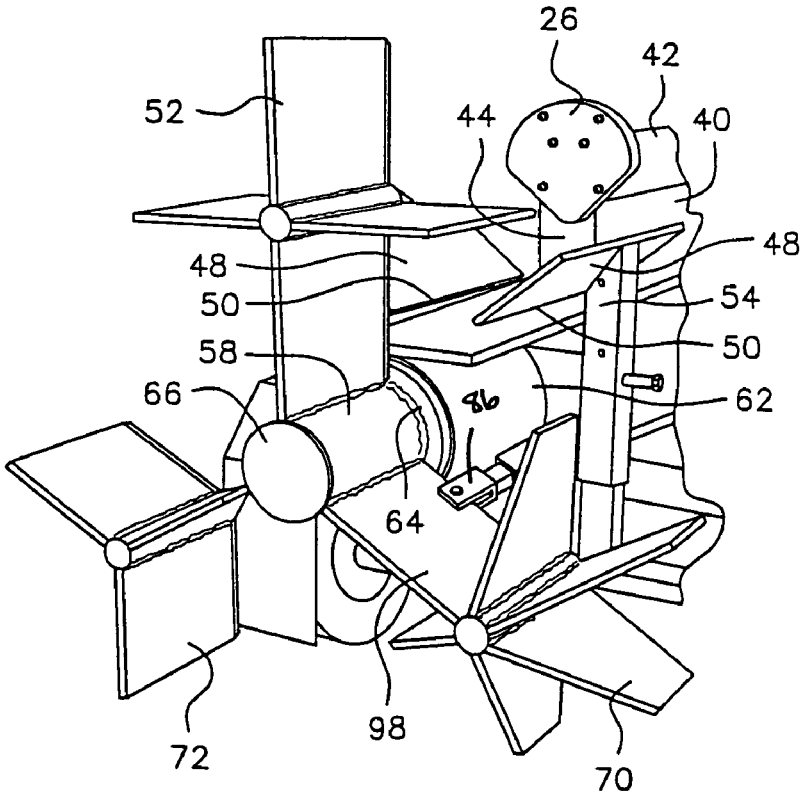
FIG. 3 is a rear perspective view of one embodiment of the present invention showing the three different wedges attached to the rotational axis.

The log 28 is positioned for splitting on a log cradle or bed generally designated by the reference numeral 46 at the proximal end of the beam 22 and plate 23 furthest from the trailer tongue 20, as in FIG. 1. As shown in FIGS. 2 and 3, the log cradle 46 includes sidewalls or cradles 48 inclined downwardly toward their adjacent opposed edges 50 to form a generally V-shaped bed for holding the log 28 to be moved by ram head 26. The adjacent edges 50 are spaced from each other a sufficient distance so that vertical plates 40 and 44 can move readily therebetween as the ram plate 26 drives the log 28 forwardly into the active splitting wedge 52.

The sidewalls 48 of the V-shaped log bed 46 are each supported on their underneath lateral sides by vertically expandable and retractable supports 54 interconnected by yoke 55 into a generally U-shaped frame as shown in FIG. 2. The supports 54 are actuated simultaneously by an adjusting hydraulic cylinder 56. In operation, the sidewalls 48 of the log cradle 46 are moved vertically by actuation of the adjusting hydraulic cylinder 56 to properly position the axial center of log 28 at the radial center of the splitting wedge 52.

The main hydraulic cylinder 24 is mounted on top of the support plate 23 for generally horizontal reciprocal movement in and out of the generally V-shaped log cradle 46 defined by the sidewalls 48. The ram plate 26 is thus adapted to be reciprocated through the log cradle 46, in order to push the log 28 to be split against the wedge 52.

Figure 4:
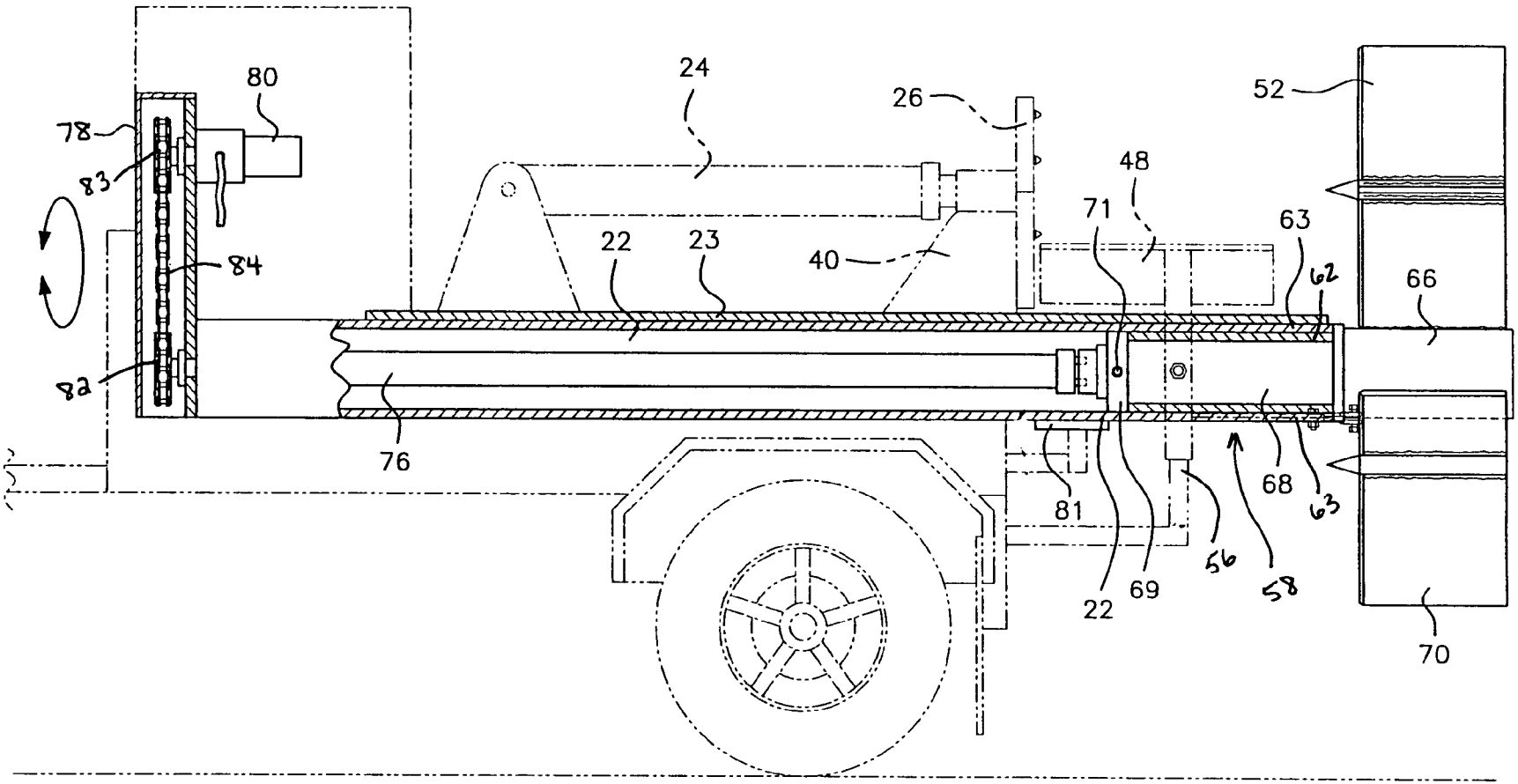
FIG. 4 is a side cutaway view showing how the rotational member can be attached to the hydraulic power on the wood splitting machine in accordance with the present invention.
Figure 6:
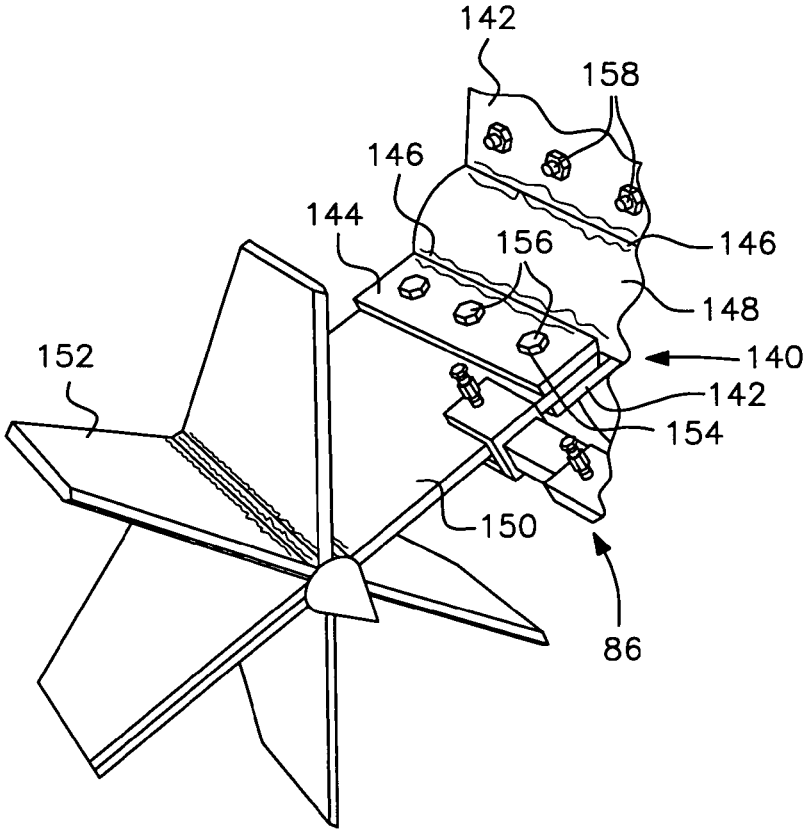
FIG. 6 is a perspective front view of a six bladed wedge having the attaching blade edge removably mounted on the rotational member in another embodiment in accordance with the present invention.
Figure 7:
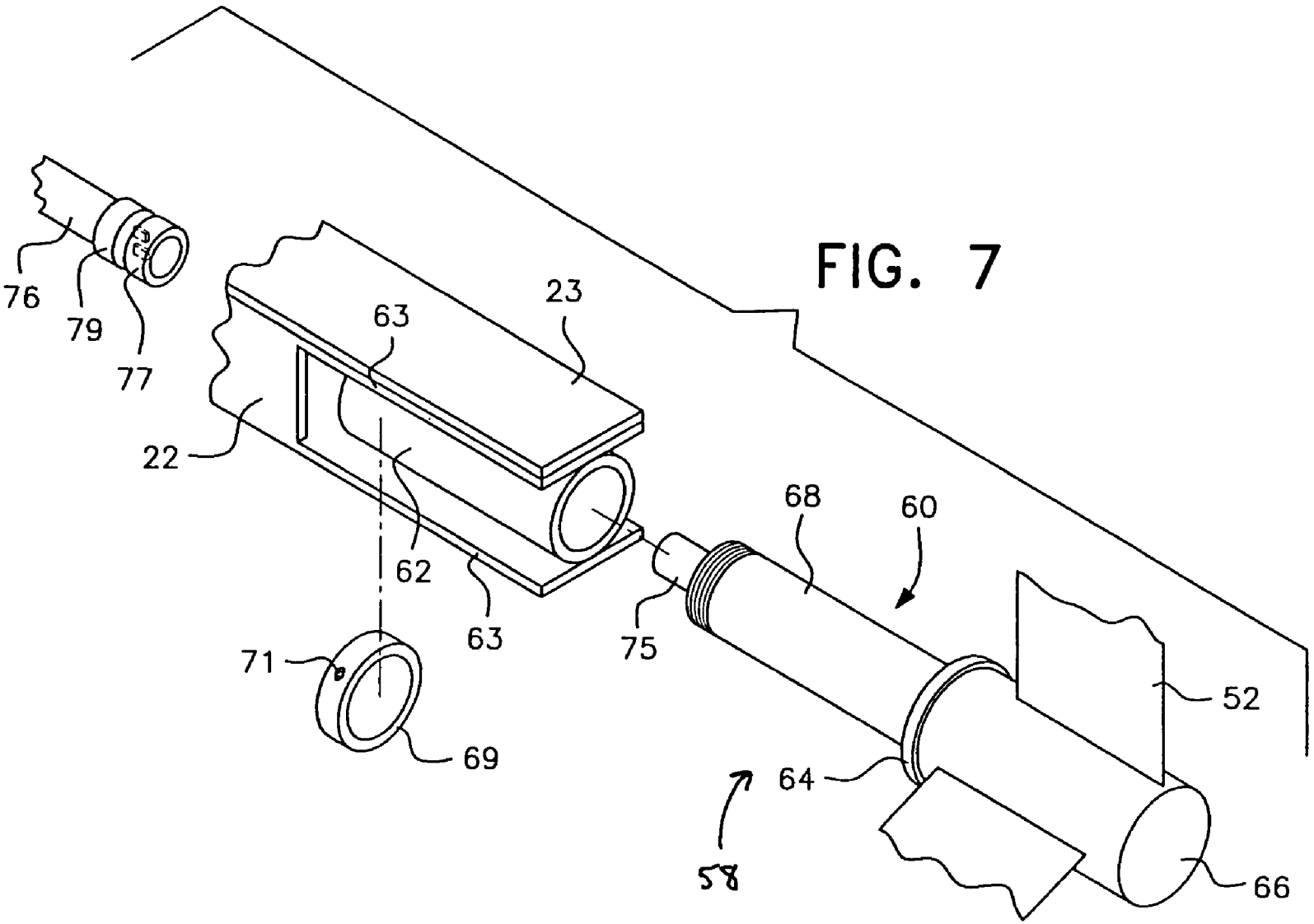
FIG. 7 is an exploded perspective view of the assembly of the rotational member on the central beam and its interconnection with the drive shaft in accordance with the present invention.

Referring now to FIGS. 4 and 7, at the proximal end of the central beam 22 and plate 23 is positioned the rotational member, generally designated by reference numeral 58. The rotational member 58 includes a cylindrical shaft, generally designated by reference numeral 60, which has one end received in a tubular bushing or bearing housing 62. The bushing or bearing housing 62 is received in a cutout at end of beam 22, leaving top and bottom extensions 63 for welding the bushing or bearing housing 62 onto the proximal end of the beam 22. The shaft 60 is preferably a solid steel rod of about 3 feet in length and is divided horizontally by a steel ring 64 which fits over and is welded onto the shaft 60 so that ring 64 divides the shaft 60 into two sections 66 and 68. The outer section 66 is about 1 foot in length and has the plurality of wedges 52, 70 and 72 generally equally spaced around and extending radially outwardly therefrom. The wedges are affixed to section 66 either by welding (FIGS. 3 and 5) or by fasteners (FIG. 6), as will be described hereinafter. The inner section 68 is about 2 feet in length and fits in the bushing or bearing housing 62.

The bushing or bearing housing 62 has an inner diameter of about 8–9 inches and acts as a sleeve for receiving shaft section 68 to rotate therein. One or more grease fittings keep the shaft section 68 lubricated as it rotates in the bushing or bearing housing 62. Alternatively, one or more bearings could be used to support the shaft 60 for rotational movement with respect to the bushing or bearing housing 62. The ring 64 welded onto the shaft 60 limits the horizontal movement of the shaft 60 into the bushing or bearing housing 62 during operation of the splitter 10 and rotation of the rotational member 58.

The distal end of shaft section 68 is threaded to receive a large nut 69 thereon which holds shaft 60 from moving out of bushing or bearing housing 62. The nut 69 is preferably round instead of hex-shaped and has a set screw 71 to hold it in place. The distal end of section 68 has an attaching pin 75 for receiving one half 77 of a Love Joy flexible rubber coupling with the outer half 79 attached to one end of a smaller diameter drive shaft 76. The drive shaft 76 extends through the central beam 22 to its other end. A removable access plate 81 is provided in central beam 22 underneath the Love Joy coupling and threaded nut 69 for maintenance and removal.

A drive housing 78 is located at the distal end of the central beam 22, and the distal end of the drive shaft 76 extends beyond the distal end of the central beam 22 and into the drive housing 78 through a suitable bearing or the like. The drive housing 78 is preferably made of a sturdy metal alloy frame that allows a hydraulic motor 80 with a reducing gear (Cross Manufacturing, Model 60, Lewis, Kans.) to be placed adjacent to the distal end of the drive shaft 76. A first sprocket 82 is affixed on the distal end of drive shaft 76, and a second sprocket 83 is fitted to the hydraulic motor 80. The second sprocket 83 communicates with the first sprocket 82 on the drive shaft 76 through a drive chain 84. The hydraulic motor 80 is attached to the main hydraulic system of the splitter 10, and can be mono, or preferably bi-directional, and is actuated by a control lever (not shown) similar to the control levers that actuate the main hydraulic ram 24 and the adjusting hydraulic cylinder 56 which raises and lowers the sidewalls 48 of the log cradle 46.

Figure 8:
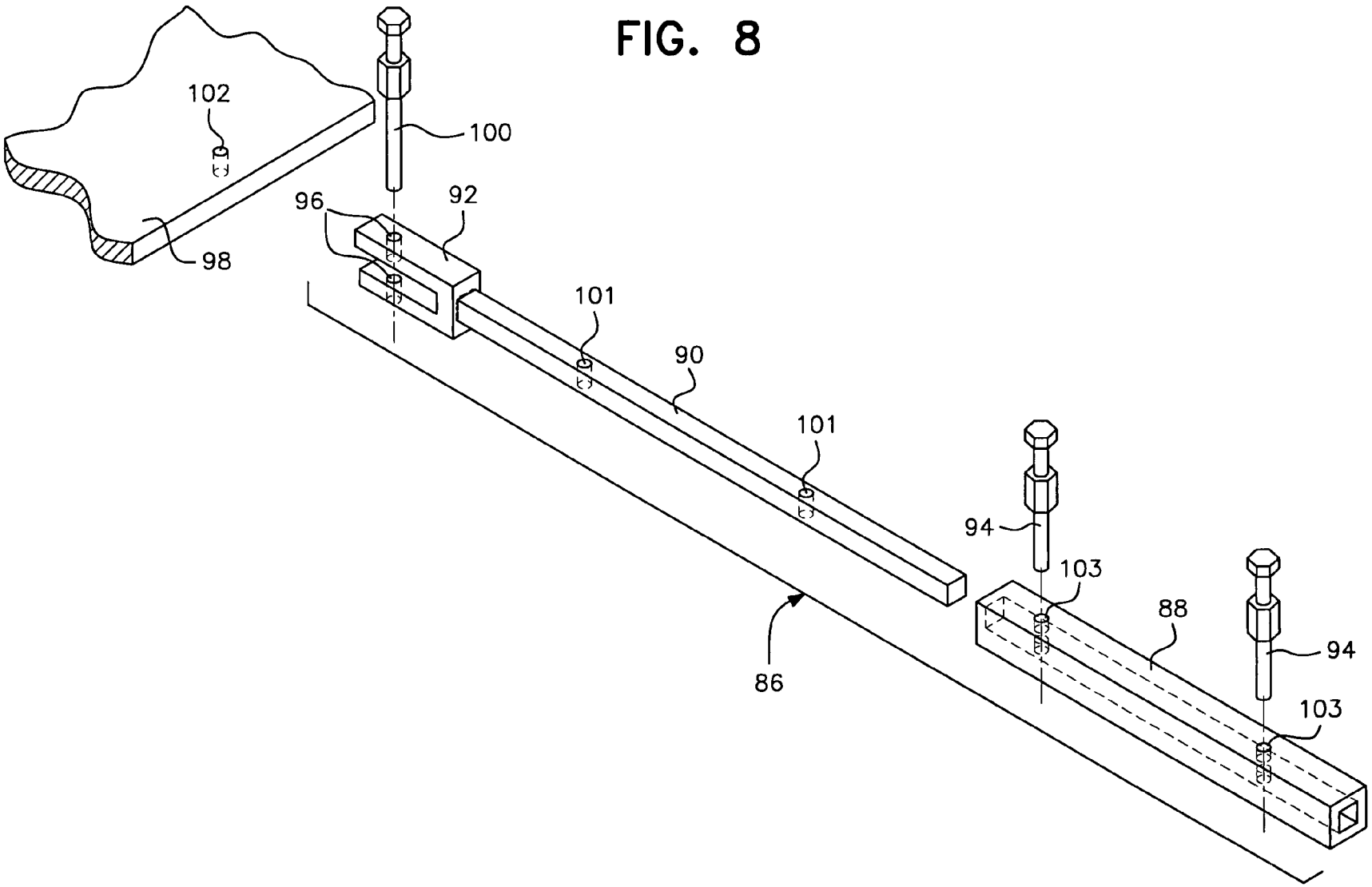
FIG. 8 is an exploded perspective view of the locking mechanism, which holds the rotational member and the splitting wedges mounted thereon in a fixed position, both longitudinally and rotationally during the splitting operation.

Using the hydraulic motor 80, the operator can rotate rotational member 58 so that the correct wedge head 52, 70 or 72 is moved into position behind the log bed 46. When the selected wedge head is aligned correctly, the operator stops the hydraulic motor 80. The locking mechanism, shown in FIG. 8 and generally designated by reference numeral 86, is then positioned on the attaching blade 98 of a non-working wedge, such as wedge 70 shown in FIGS. 3 and 5. The locking mechanism 86 is mounted on one side of the bushing or bearing housing 62 in a generally horizontal position and extends forwardly or outwardly for attachment to a non-working wedge blade (See FIG. 1). The locking mechanism 86 consists of two parts, a tubular housing or sleeve 88 that is affixed to the bushing or bearing housing 62 (or other frame component) by a bracket, weldment or other suitable attachment, and a metal rod 90 that is slidably received within the sleeve 88. The distal end of the rod 90 is formed as a clevis 92 for attachment to the non-working wedge blade. The rod 90 is manually moved further into the sleeve 88 when not in use. When in use, the rod 90 is moved outwardly in the sleeve 88 a partial distance and the clevis 92 is positioned for attachment to the attaching blade 98 of one of the non-working wedges. The clevis 92 is then attached to blade 98 with slide in pins 100 through aligned holes 96 in the clevis and attaching hole 102 in the attaching blade, and the rod 90 is rigidified in sleeve 88 by inserting slide in pins 94 through aligned holes 101 and 103. An alternative locking arrangement could use a locking device on a handle on rod 90 that would lock into place manually when clevis 92 is engaged or disengaged onto wedge blade 98.

The attachment of the clevis 92 to the blade 98 and the rigidifying of the rod 90 in the sleeve 88 holds the rotational member 58 and the wedges thereon in position both longitudinally and rotationally for the log splitting operation. Each attaching blade 98 has the hole 102 for receiving the slide in pin 100 through the clevis 92 for holding an adjacent splitting wedge in working position behind log cradle 46.

Figure 9:
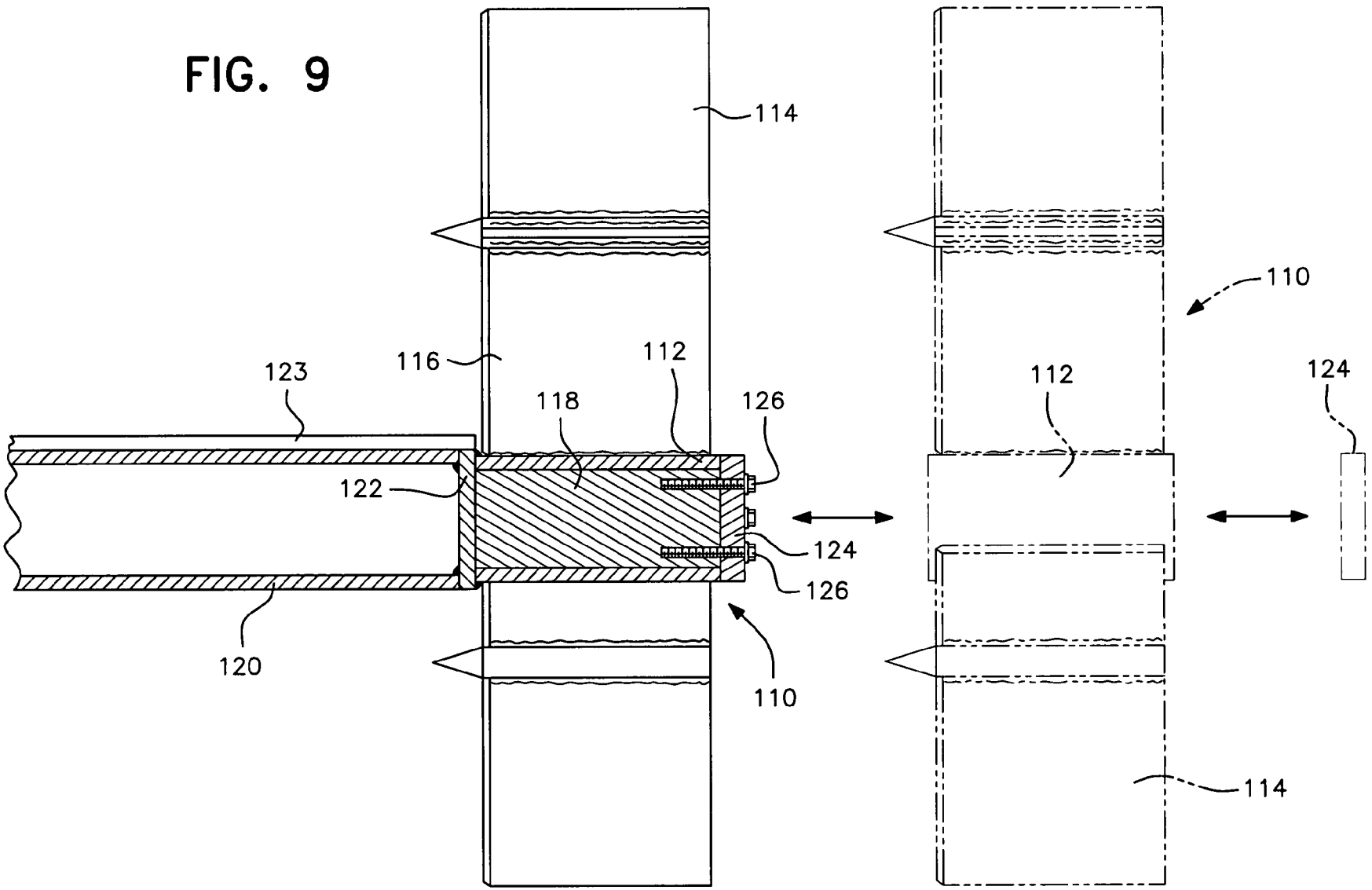
FIG. 9 is a side view of an alternate embodiment of the rotational member in accordance with the present invention.

A manual-only alternate embodiment for the rotational member and attached splitting wedges assembly is shown in FIG. 9, and generally designated by reference numeral 110. The rotational member is in the form of a tubular sleeve 112 and wedges 114 are mounted thereon by attaching blades 116. The sleeve 112 is mounted for rotational movement on a cold rolled axle shaft 118 which is welded or otherwise affixed to the end of a central H-beam 120 through end cap or plate 122. Horizontal plate 123 is welded on top of the beam 120 to support the main power ram hydraulic cylinder 24 and its operation as previously described.

An end cap or plate 124 is mounted on the end of shaft 118 by bolts 126 or the like. The peripheral edges of the plates 122 and 124 hold the sleeve 112 therebetween so that the rotational member 110 and the wedges 114 thereon are fixed longitudinally during the splitting operation. A locking mechanism similar to mechanism 86 previously described can be used to hold the assembly 110 from rotating. Alternatively, the sleeve 112 can be slightly longer than shaft 118 so that cap or plate 124 fixes sleeve 112, and the rotating assembly 110, between the facing peripheries of plates 122 and 124, when bolts 126 are tightened in the end of shaft 118. The bolts 126 would then be unscrewed to release the pressure caused by the plates 122 and 124 on the sleeve 112 so that the rotational member could be manually rotated to change the working splitting wedge.

FIG. 2 shows a head on rear view of the rotational member 58 and three radially mounted wedge heads 52, 70 and 72 in accordance with the present invention. In the drawing figure, the three wedge heads include a three-blade head 72, a four-blade head 52, and a six-blade head 70 which are mounted on the rotational member 58. There can be multiple combinations of wedge heads, and it is contemplated that there are at least two, and preferably three or more, wedge heads that could be mounted on the rotational member 58.

Figure 5:
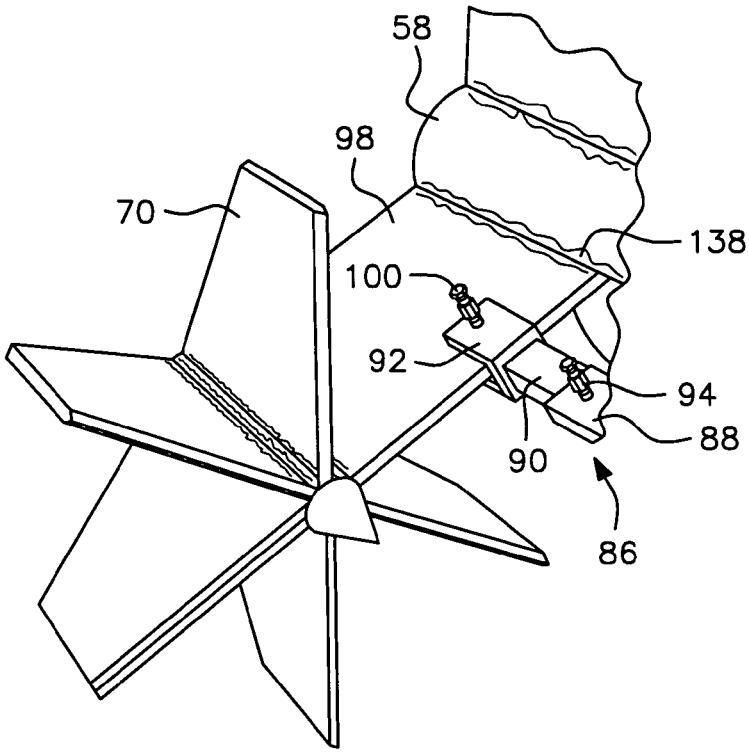
FIG. 5 is a perspective front view of a six bladed wedge showing a wedge blade outer edge welded onto the rotational member in one embodiment in accordance with the present invention.

While FIG. 5 shows the mounting of the attaching blade 98 of wedge 70 onto the rotational member 58 by welds 138 for the FIGS. 1–5 hydraulically operated embodiment, an alternative attaching mechanism, generally designated by reference numeral 140 is shown in FIG. 6. In the attaching mechanism 140, a pair of small plates 142 and 144 are attached by welds 146 along their edges to the rotational member 148 so as to extend radially from the rotational member. The spacing between the plates 142 and 144 is sized to receive the attaching blade 150 of splitting wedge 152. The attaching end of the attaching blade 150 has holes to align with holes 154 for receiving bolts 156 therein. Nuts 158 are threaded onto the ends of the bolts 156 to secure the attaching blade 150 between plates 142 and 144. The obvious advantage of this alternate embodiment is the ability to switch out alternate splitting wedges from the rotating member 148 without having to replace the entire rotational member.

In the present invention, it is contemplated that the log splitter can also be fitted with any conventional hydraulic loader chute. The loader chutes are typically made of metal or an alloy and affixed to the frame adjacent to the log bed 46. The loader chute can be hingedly attached to the frame with a series of pins so that it can swing from a vertical position nearest the ground to a position about 270° or just above the top of the splitter and is attached to a third hydraulic cylinder. It is also contemplated that the chute can be detached from the third hydraulic cylinder so that the entire chute can be moved into a vertical position over the log splitter for transport. In operation the chute is lowered to a convenient vertical position so that the operator can load a number of logs onto the chute. The operator then actuates the third hydraulic cylinder to lift the chute in a clockwise manner from the loading position to a higher position to allow gravity to roll the logs into the log bed.

In operation of the preferred embodiment shown in FIGS. 1–5, the operator loads a log 28 into the log bed 46 and observes the diameter of the log 28 to be split. If a different wedge size is desired, the operator first removes and retracts the locking mechanism 86 from the attaching wedge blade 98. The rotational member 58 can then be rotated by actuating the hydraulic motor 80 to rotate the drive shaft 76 in the central beam 22 until the desired wedge head is rotated into alignment with the log 28. Rotation is then stopped and the locking mechanism reinstalled. The operator then can actuate the adjusting hydraulic cylinder 56 to raise or lower the sidewalls 48 of the log bed 46 so that the log 28 is at the proper height for splitting. The main hydraulic cylinder 24 is actuated to force the ram 26 against the end of the log 28 to drive the log through the wedge head for splitting the log 28.

For operation of the alternate, manual embodiment, the general operation is the same, except that after the operator has placed the log in the log bed and adjusted the height, and detached and retracted the locking mechanism if attached, the rotational member 110 is manually turned to position the desired wedge head 114 into position. The locking mechanism is replaced in order to secure the rotational member 110 and the new working wedge in place for the splitting operation.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed is:

1. A woodsplitter comprising:

a frame;

a hydraulic cylinder mounted on said frame on one side of a log bed to drive a log in said log bed toward a splitting wedge head positioned on an opposite side of said log bed; and a rotational member mounted on said frame for rotational movement and having a plurality of splitting wedge heads mounted thereon, each of said wedge heads having a plurality of splitting wedge blades and being individually selectively positioned to split a log by rotating said rotational member to align the selected one of said splitting wedge heads with the log to be split.

2. The woodsplitter of claim 1, wherein said hydraulic cylinder has a ram plate to engage said log and drive said log through said selectively positioned wedge head, said ram plate being supported on said frame for sliding movement in a generally horizontal direction.

3. The woodsplitter of claim 1, wherein said rotational member is hydraulically rotated to selectively position a splitting wedge head for splitting said log.

4. The woodsplitter of claim 1, wherein said rotational member is manually rotated to selectively position a splitting wedge head for splitting said log.

5. The woodsplitter of claim 1, wherein said plurality of splitting wedge blades for each wedge head are of a different size.

6. The woodsplitter of claim 1, wherein said plurality of wedge heads includes three splitting wedge heads extending outwardly from, and spaced equally around, said rotational member, each of said wedge heads having a different number of blades.

7. The woodsplitter of claim 1, wherein said log bed is hydraulically movable vertically to position said log to be split into generally axial alignment with a longitudinal center of said selectively positioned splitting wedge head.

8. The woodsplitter of claim 1, wherein said frame is mobile.

9. The woodsplitter of claim 1, wherein said plurality of splitting wedge heads are mounted on said rotational member in different radial directions by having only one blade of each wedge head mounted on said rotational member.

10. The woodsplitter of claim 9, wherein said one blade is detachably connected to said rotational member.

11. The woodsplitter of claim 1, wherein said rotational member is removably mounted on said frame for replacement and substitution of another rotational member having different size wedge heads mounted thereon.

12. The woodsplitter of claim 1, wherein said rotational movement of the rotational member is around a generally longitudinal axis of said frame.

13. The woodsplitter of claim 1, further comprising a locking mechanism to rigidly hold said rotational member and splitting wedge heads mounted thereon in a fixed position longitudinally and rotationally during operation of said hydraulic cylinder to drive a log through said selected splitting wedge head.

14. A woodsplitter comprising:

a frame;

a hydraulic cylinder mounted on said frame on one side of a log bed to drive a log in said log bed toward a splitting wedge head positioned on an opposite side of said log bed; and a rotational member mounted on said frame for rotational movement and having a plurality of splitting wedge heads connected thereto, a selected one of said splitting wedge heads being individually positioned for alignment with a log to be split by rotating said rotational member around a generally longitudinal axis of said rotational member.

15. The woodsplitter of claim 14, wherein said rotational member is bi-directional and a hydraulic motor rotates said rotational member up to 360° around said longitudinal axis.

16. The woodsplitter of claim 14, wherein said plurality of splitting wedge heads are spaced substantially equally around said rotational member, each of said heads having only one blade mounted to said rotational member.

17. A woodsplitter comprising:

a frame;

a hydraulic cylinder mounted on said frame on one side of a log bed to drive a log in said log bed toward a splitting wedge head positioned on an opposite side of said log bed; and a rotational member mounted on said frame for rotational movement and having a plurality of splitting wedge heads mounted thereon, a selected one of said splitting wedge heads being individually positioned for alignment with a log to be split by rotating said rotational member, each of said plurality of splitting wedge heads having a different number of blades.

18. The woodsplitter of claim 17, wherein said rotational member is hydraulically rotated to selectively position the selected one of said splitting wedge heads for splitting said log.

19. The woodsplitter of claim 17, wherein said plurality of splitting wedge heads includes three splitting wedge heads extending outwardly from, and spaced substantially equally around said rotational member, each of said heads having only one blade mounted to said rotational member.

20. The woodsplitter of claim 16, further comprising a locking mechanism to rigidly hold said rotational member and splitting wedge heads mounted thereon in a fixed position longitudinally and rotationally during operation of said hydraulic cylinder to drive a log through said selected splitting wedge head.

* * * * *